US008464725B2

(12) United States Patent
Badawi

(10) Patent No.: US 8,464,725 B2
(45) Date of Patent: Jun. 18, 2013

(54) HOOKAH BOWL

(75) Inventor: Mahmoud Badawi, Falls Church, VA (US)

(73) Assignee: Mya Saray, LLC, Sterling, VA (US)

( * ) Notice: Subject to any disclaimer, the term of this patent is extended or adjusted under 35 U.S.C. 154(b) by 890 days.

(21) Appl. No.: 12/580,814

(22) Filed: Oct. 16, 2009

(65) Prior Publication Data

US 2011/0088706 A1 Apr. 21, 2011

(51) Int. Cl.
*A24F 1/30* (2006.01)

(52) U.S. Cl.
USPC ..... 131/173; D27/162

(58) Field of Classification Search
USPC ..... 131/173; D27/162, 163, 167, 168
See application file for complete search history.

(56) References Cited

U.S. PATENT DOCUMENTS 6,318,376 B1 * 11/2001 Cheng ..... 131/215.2
D618,389 S * 6/2010 Masri ..... D27/162
D632,426 S * 2/2011 Badawi ..... D27/162
2007/0056599 A1 3/2007 Zoumut

* cited by examiner

*Primary Examiner* — Richard Crispino
*Assistant Examiner* — Dionne Walls Mayes
(74) *Attorney, Agent, or Firm* — Da Vinci's Notebook, LLC

(57) ABSTRACT

The present invention is directed to a hookah bowl with a central spire and a hookah bowl system with the hookah bowl and a coal plate. The coal plate fits about the spire and may be retained upon the hookah bowl via multiple means. The spire assists transportation, attachment, use, and removal of the hookah bowl.

15 Claims, 6 Drawing Sheets

HOOKAH BOWL

FIELD OF THE INVENTION

The present invention relates to the field of smoke-wetting implements and more specifically to the field of hookahs.

BACKGROUND

Of the many proud traditions of Ottoman culture, few have achieved the world-wide fame of hookah smoking. Once confined to the Middle East and Near East regions, the hookah's notoriety was invigorated by Napoleon's invasion of Egypt and the stream of curious Westerners which followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a base, a stem, at least one hose with a mouthpiece, and a bowl. The hookah bowl holds the hookah tobacco, frequently "massell." Massell is a mixture of tobacco, molasses, and often a flavor or fruit extract, The molasses and fruit extract add a substantial amount of moisture to the massell that is missing in conventional tobacco. This added moisture makes massell more sensitive to the elements relative to conventional tobacco;

prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah bowl to allow heat to evenly circulate through the pile.

The heat that ignites the massell derives from coals positioned above the hookah bowl. The coals and massell preferably never contact one to the other. A common method of placing coals proximate to the massell involves spreading a foil upon the top of a hookah bowl, punching holes in the foil, and then placing the coals onto the foil. The heat from the lighted coals travels through the holes in the foil to ignite portions of the massell. Particulates from the massell travel in the smoke created by the ignition down through the hookah bowl into the hookah pipe.

The hookah stem is the body of a hookah and is usually fabricated from brass, tin, or stainless steel. The stem transports the massell smoke from the bowl to the hookah base, which is a cavern containing water. The base of the hookah is typically fabricated of glass or plastic and tends to be the most expressive portion of the hookah, ranging from translucent to wildly-colored. Within the cavern of the hookah base, the massell smoke is cooled by the water within. The cooled massell smoke then returns to the stem, though not through the same entrance by which the massell smoke enters the base. From the stem, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the stem and the hookah bowl. The Egyptian style hookah pipe tapers upward into what is generally referred to as a male connection. The Egyptian style hookah bowl includes a female connection which receives the pipe's male connection. In the Lebanese style hookah the bowl has the tapered male connection and the pipe has the female connection to accept the Lebanese style hookah bowl. In both styles, to allow a more airtight connection a collar is generally added to fit around the male connection.

As hookah use increases in prominence, the need to make hookah smoking more amenable to a larger market increases in importance. Unlike cigarettes, pipes, cigars, and many other portable smoking instruments, a hookah lacks a means for effective movement of the combustion unit while in use. A pipe user may grasp the handle of the pipe and the cigarette and cigar holder positions her fingers distant from the burning tip, but a hookah bowl generally lacks an extremity and instead relies upon the use of heat-dissipating construction materials or users knowledgeable enough to utilize heat shielding (e.g., gloves). Furthermore, pipes, cigars, and cigarettes employ a unitary construction that permits motion to be reliably translated throughout the body of the device. Hookahs may include multiple components fastened with crude attachment implement, (e.g. tape or cloths).

Therefore, there is a need for a hookah bowl that accommodates a hookah stem portion and permits simple affixation, transport, and removal of the hookah bowl during combustion.

SUMMARY

The present invention is directed to a hookah bowl system and hookah bowl. The hookah bowl includes a bowl body with a floor and a raised peripheral wall that circumscribes the floor. The body includes a base aperture with a sidewall that mates with a hookah stem connection. A dry smoke aperture in the floor permits communication into the base aperture. The centrally affixed upon the floor is a bowl spire that extends above the raised peripheral wall. A preferred height of the spire is greater than twice the height of the raised peripheral wall. The spire permits a user to grasp the bowl from above, but away from, the raised peripheral wall for simple attachment of the bowl upon a hookah stem. The spire positioning further simplifies removal as a user may use radial force, rather than longitudinal force away from the hookah stem, to remove the hookah bowl.

The system of the present invention includes the bowl with a longitudinally movable perforated coal plate a means for fixing the position of the coal plate upon the spire. Means of fixing the position of the coal plate include a removable barrier, fixed barrier, a raised peripheral wall diameter less than or equal to the diameter of the coal plate, a spire girth adapted to provide a close fit between the spire and coal plate, and other mechanisms described herein.

Therefore, it is an aspect of the present invention to provide a hookah bowl and system that provides a user with an advantageous means of attachment and removal.

Therefore, it is an aspect of the present invention to provide a hookah bowl and system that provides a rotatable coal plate.

Therefore, it is an aspect of the present invention to provide a hookah bowl and system that accommodates a transversely-stabilized coal plate.

Therefore, it is an aspect of the present invention to provide a hookah bowl and system that provides effective transportation of a hookah bowl during combustion.

Therefore, it is an aspect of the present invention to provide a hookah bowl and system that allows removal and affixation of a hookah bowl without contacting the peripheral wall.

Therefore, it is an aspect of the present invention to provide a hookah bowl and system to that allows selective positioning of a coal plate upon a hookah bowl.

Therefore, it is an aspect of the present invention to provide a hookah bowl and system that allows selective positioning of a coal plate upon a hookah bowl irrespective of bowl dimensions.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
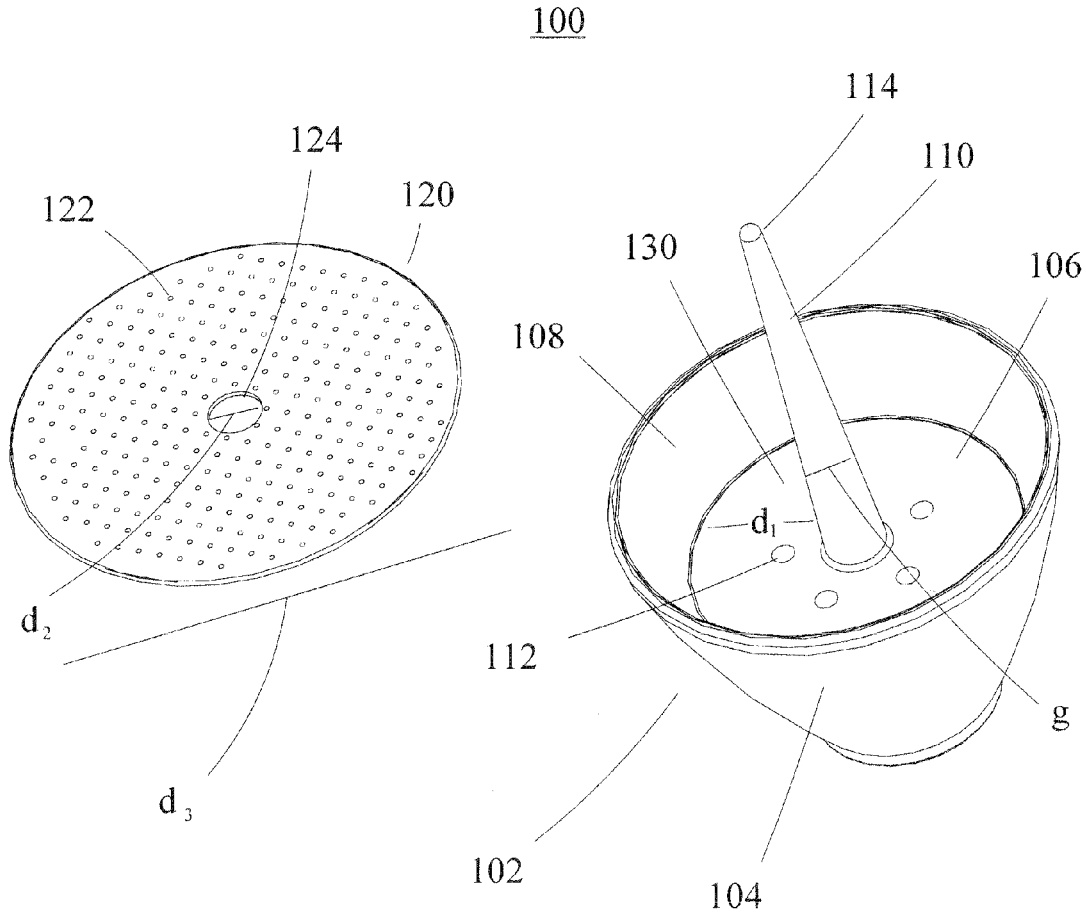
FIG. 1 is a perspective view of the system of the present invention.

Referring first to FIG. 1, a basic embodiment of a system 100 of the present invention is shown. The system 100 includes a hookah bowl 102 and a coal plate 120. The hookah bowl 102 includes a bowl body 104 with a floor 106 and a raised peripheral wall 108 that circumscribes the floor 106. A bay 130 is formed in the open space bounded by the wall 108 and the floor 106. Within the floor 106 are one or more dry smoke apertures 112. Centrally positioned within the bay 130 and upon the floor is a spire 110 that extends above the raised peripheral wall 108. Preferred heights for the spire include heights 1.25 times the height of the wall 108 and greater. Although the spire 110 may include multiple dimensions and configurations, a preferred spire configuration is disclosed in FIG. 1.

The spire 110 may assumes functions, including stability, heat dissipation, and placement. A spire increases the stability of the coal plate as a coal plate generally lacks support as it is placed upon the hookah bowl. The spire running through the body of the coal plate, irrespective of whether a close fit (i.e., minimum clearance fit) is achieved, provides a central barrier that prevents significant lateral motion of the coal plate. To assist with heat dissipation, the spire may include a solid interior to permit a greater volume of mass. The spire, or a portion thereof, may be constructed of a material different from that of the bowl. A preferred bowl and spire construction material includes ceramic or clay. A solid interior spire construction further permits greater latitudinal force to be applied to the spire in placement and removal of the bowl. As a spire apex 114 increases in height, the girth g of the spire 110 should increase accordingly. The girth g of the spire 110 may be generally uniform, or may be variable along the height thereof. A preferred embodiment of the bowl 102 includes a spire 110 with a girth g that gradually diminishes downwardly from the apex of the spire.

The perforated coal plate 120 of the system 100 of the present invention serves to support combustible materials, e.g. coals, and preferably includes dimensions that are substantially planar in height and mimic the shape of the bowl 102 otherwise. Shapes of the coal plate 110 and bowl 102 may include rectangular, circular, polygonal, and other shapes—as viewed from above. The coal plate 120 includes perforations 122 that permit heat from the combustible materials to traverse the body of the coal plate 120 into the howl. The coal plate 120 includes a central plate aperture 124 with a plate aperture diameter $d_2$.

Figure 2:
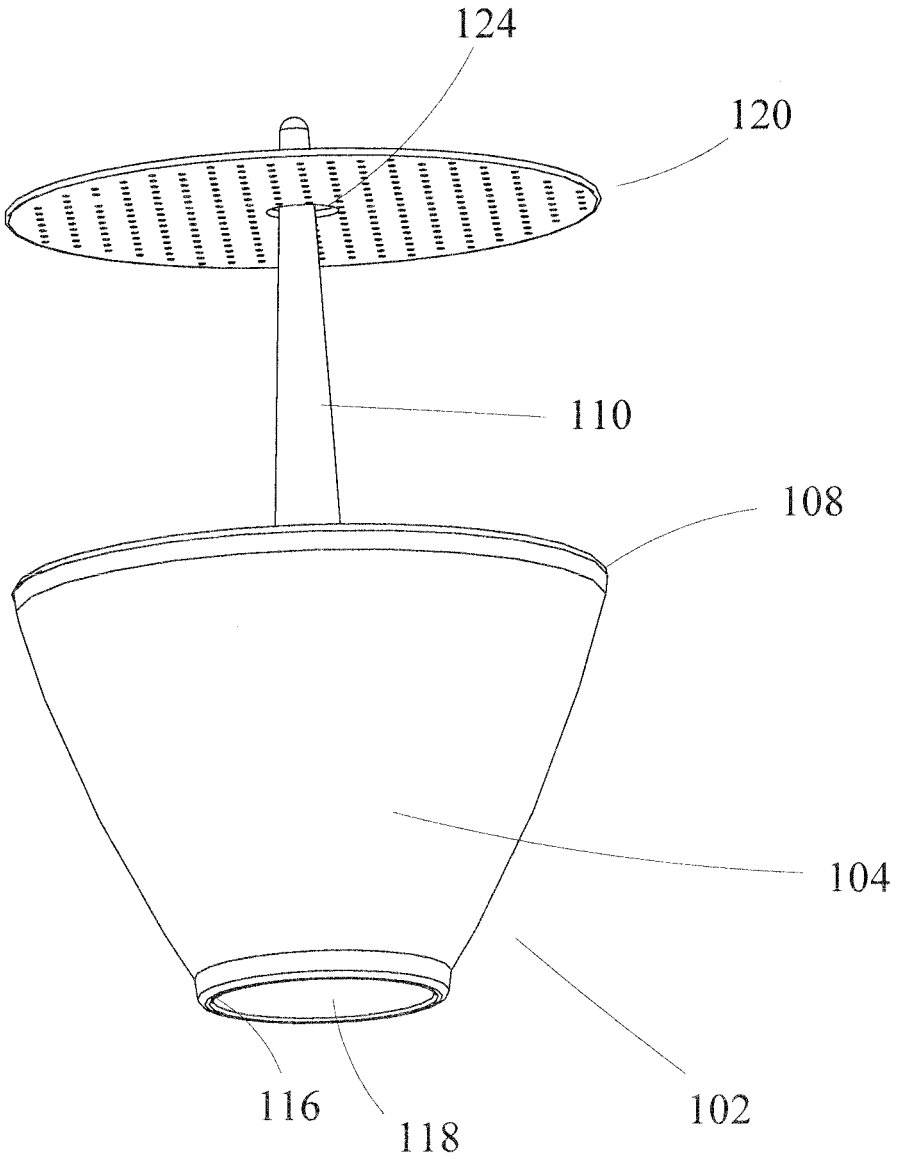
FIG. 2 is a perspective view of the system of the present invention.
Figure 3:
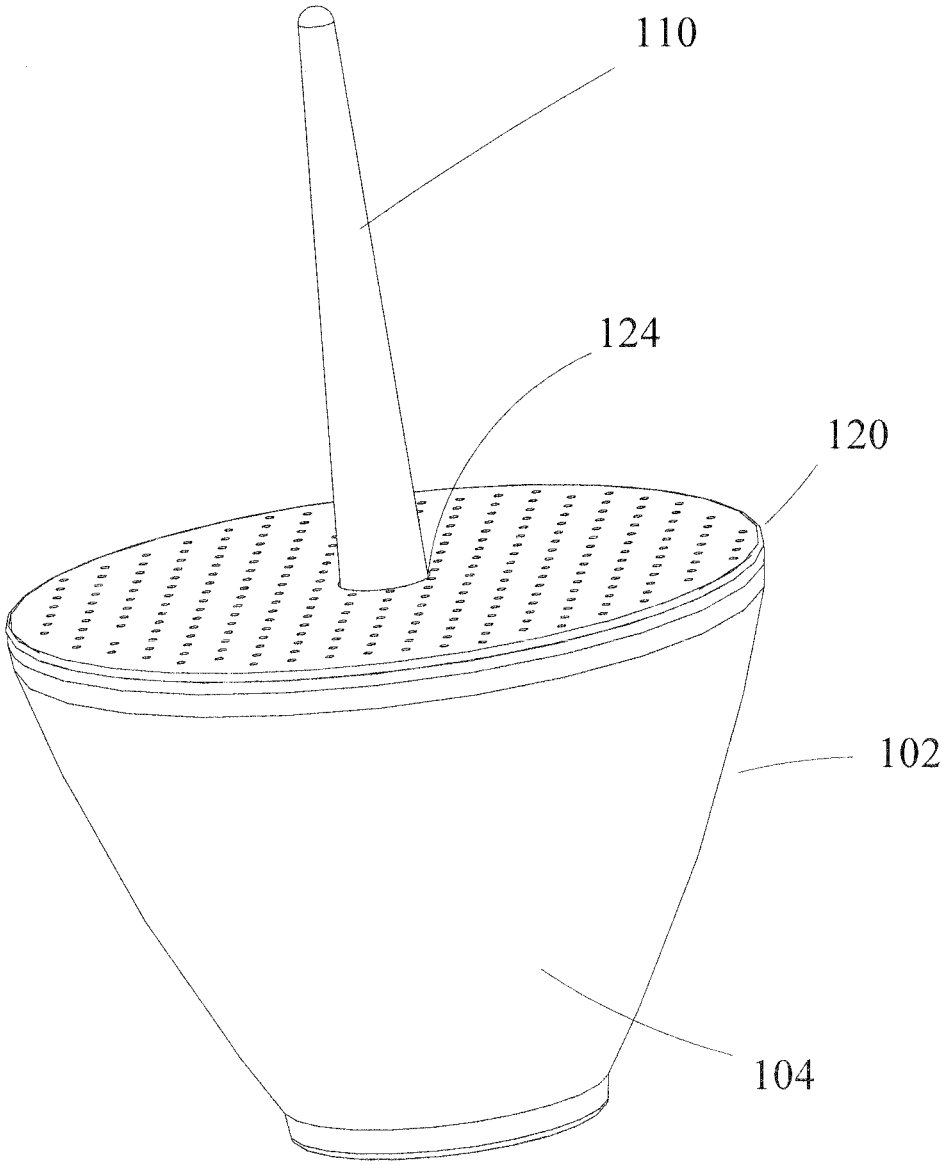
FIG. 3 is a perspective view of the system of the present invention.

A preferred system 100 of the present invention includes a peripheral support means of positioning the coal plate 120 about the hookah bowl 102. The peripheral wall 108 is located a distance of diameter $d_1$ from a central point occupied by the spire 110. The peripheral wall diameter $d_1$ need not be constant, and indeed, preferably slopes gradually inward with respect to the floor 106. The wall diameter $d_1$ is less than or equal to the coal plate diameter $d_3$ at the point of contact. As shown by FIGS. 2 and 3, the coal plate 120 slides down the spire 110 through the central aperture 124. As the coal plate 120 longitudinally traverses the spire 110 the central aperture 124 is sized is accommodate the entirety of the spire 110 positioned above the plane of the apex of the wall 108. The coal plate 120 rests upon the wall 108 for support. The coal plate 120 may rest upon the wall in multiple ways, including use of indentures in the wall and plate wherein the interlocking effect is mutually supporting, but the preferred means of wall support of the coal plate includes a wall that with a substantially uniform height and a coal plate with a substantially planar periphery along portions that would contact the wall. A coal plate planar periphery mated with a substantially uniform wall height permits the coal plate to rotate on the wall about the spire. The radial motion of the coal plate allows a user to selectively burn tobacco within the tobacco bowl with reference to the placement of coal upon the coal plate. Coals, and other combustible materials, are not always uniformly dispersed about a coal plate. Non-uniform coal distribution may lead to non-uniform tobacco burn and the ability to rotate the coal allows a user to select portions of tobacco to burn, while the central placement of the spire ensures that tobacco will be placed in a non-central location within the hookah bowl.

The extents, or other portions, of the bowl wall 108 and coal plate 120 need not be dimensioned for wall support. Another means of positioning the coal plate 120 upon the spire 110 includes correlating the spire girth g and central aperture diameter $d_2$ to form a close fit arrangement at a position predefined for effective burning of tobacco within the tobacco bowl 102. Effective burning of tobacco occurs when a commercial coal array when placed upon the coal plate can burn commercial tobacco positioned upon the floor of the hookah bowl. A preferred arrangement includes a position proximate to the height of the peripheral wall 108.

The close fit occurs at the point where g approaches $d_2$ in magnitude. In discussing the spire, but applicable to all such mentions of diameter, girth, and the like, it is important to note that the dimensions of the present invention are not limited to circular and quasi-circular shapes and may include any shape suitable to achieve any aspect of the present invention. For example, a rectangular central aperture 124 and rectangular cross-sectioned spire 110 may be desirable. The preferred spire 110 is symmetrical by cross-section to permit radial motion by the coal plate. The close fit between the spire 110 and the coal plate 108 may occur above the peripheral wall 108 apex or below the peripheral wall 108 apex.

Figure 4:
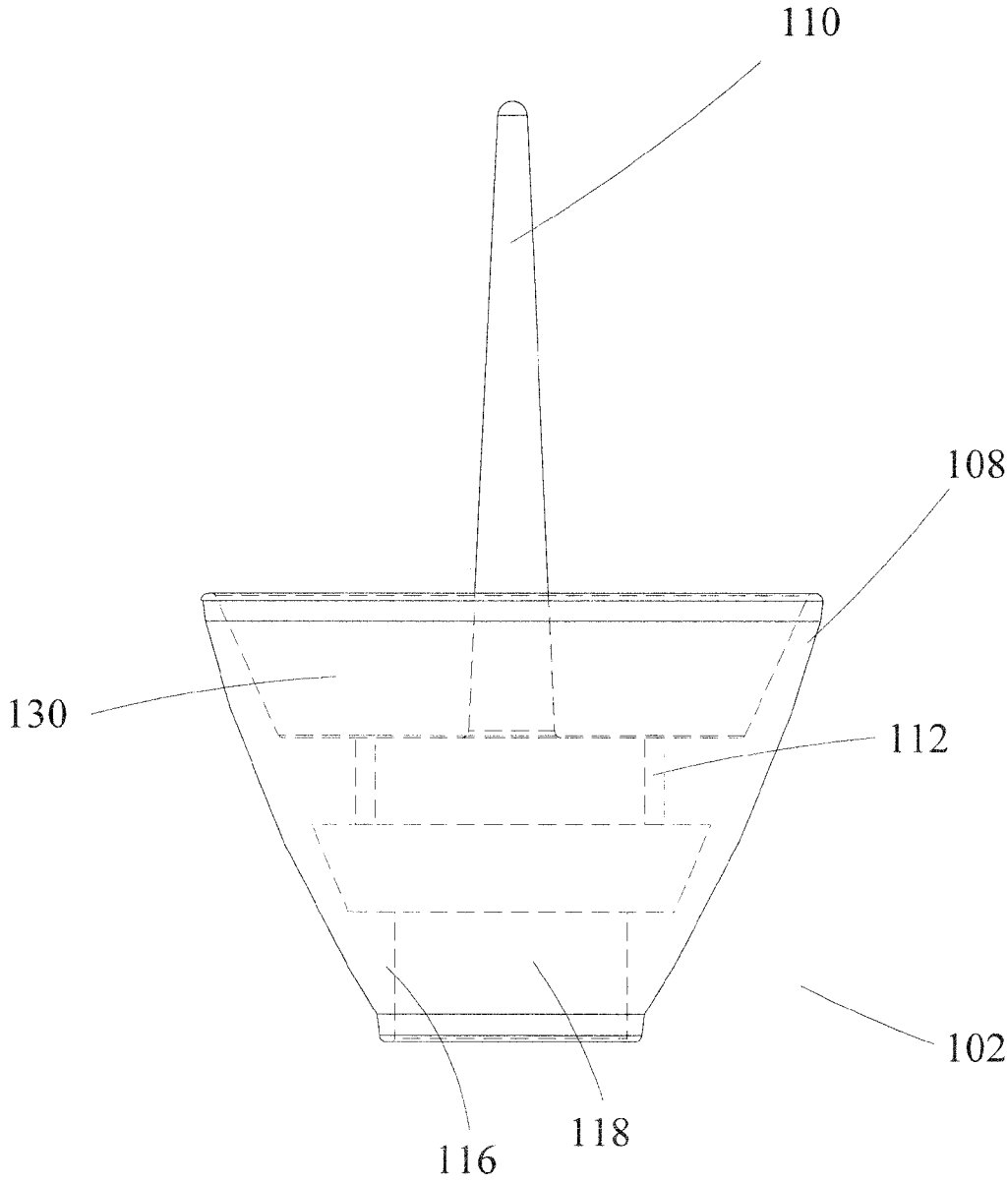
FIG. 4 is a cutaway view of the bowl of the present invention.

As FIG. 4 shows, the tobacco burned within the bay 130 passes through one or more dry smoke apertures 112 to a base aperture 118 formed by a base sidewall 116. The base sidewall 116 may be dimensioned to connect to a hookah stem through either direct connect or some other medium, including a grommet or other compressible device.

Figure 5:
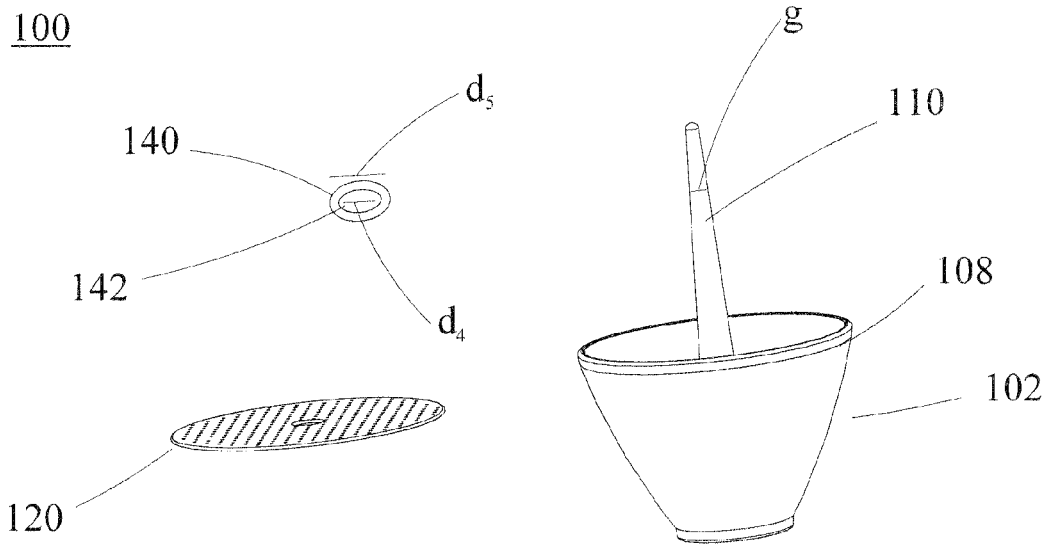
FIG. 5 is a perspective view of the system of the present invention.

As FIG. 5 shows, the system 100 or the present invention may include a barrier 140 detachable from the spire 110. The detachable barrier 140 includes a barrier diameter $d_5$ and a barrier aperture 142 with a harrier aperture diameter $d_4$. The barrier aperture 142 accepts the spire along portions of the spire amenable to effective combustion of tobacco. It is preferred that the barrier 140 include an elastic construction to ensure sealed contact with the spire 110. To promote aspects of rotatability of the coal plate 120 about the spire 110, a washer may be placed above the harrier 140 upon which the coal plate 120 may sit. The barrier diameter $d_4$ is dimensioned such that the central aperture 124 cannot pass through the barrier. The barrier 140 includes a diameter $d_5$ that is greater than the girth g of the spire 110 at portions contiguous, i.e. immediately below and above (when applicable), to the barrier in its position on the spire. A second barrier 140 may be included for placement about the top surface of the coal plate 120 to prevent longitudinal movement of the coal plate 120 during turbulent uses of a hookah, e.g. smoking while walking. The preferred second barrier 140 includes a weighted ring or an elastic ring.

Figure 6:
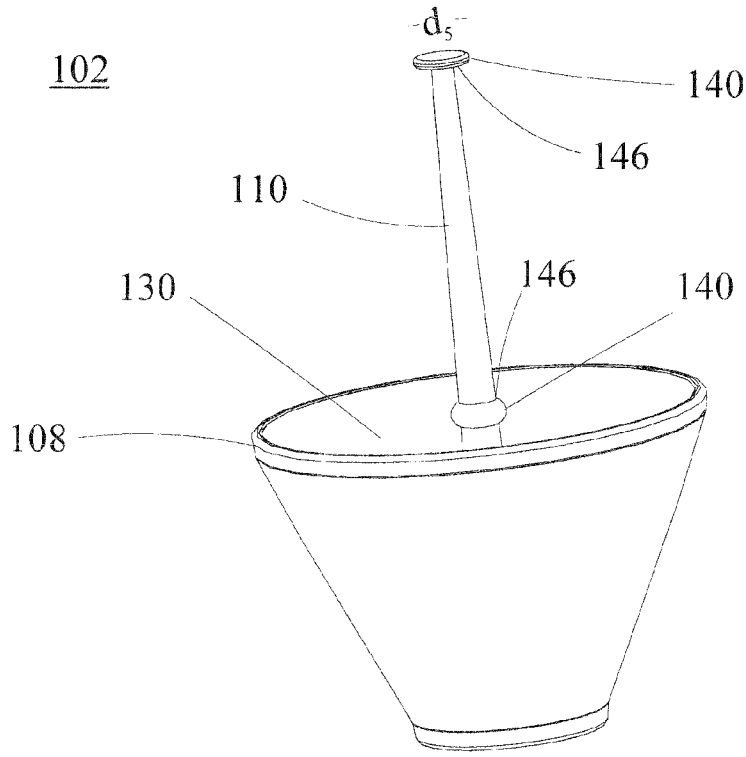
FIG. 6 is a perspective view of the bowl of the present invention.

Turning now to FIG. 6, the bowl 102 of the present invention may include barriers 140 fixed along the spire 110. The fixed barriers 140 are permanently attached to the spire 110 and serve to block the longitudinal motion of the coal plate (not shown) along the spire 110. A spire 110 may include a single fixed barrier 140 or multiple fixed barriers 140. If a fixed barrier 140 is present, it is preferred that at least one fixed barrier be positioned in an inferior position, i.e. a lower position adapted to position a coal plate above the bay 130 in a location suitable for effective burning of tobacco within the bay 130. The fixed barrier 140 includes a contact surface 146, which is the surface of the barrier 140 that naturally contacts the coal plate 120. The contact surface 146 may include any configuration, but it is preferred that the barrier 140 posses a substantially planar contact surface 146 to allow a coal plate with a substantially planer lower surface to rotate about the spire. The inferior fixed barrier blocks downward movement of the coal plate proximate to the bay and permits a coal plate of dimensions less than those of the peripheral wall 108 to be used effectively with the bowl. A superior fixed barrier, when present, blocks upward movement of the coal plate at any position deemed pertinent. A natural position for the superior barrier is proximate to the spire apex 114. Use of two fixed barriers permits a coal plate to be permanently positioned on the spire with a fixed path of travel between the two barriers rather than permitting a user to selectively remove the coal plate from the spire.

A user of the bowl of the present invention can position the bowl on a hookah stem (not shown) by grasping and moving the bowl by the spire toward a hookah stem connection. The bowl may be guided solely by the spire and downwardly positioned on to the hookah stem attachment with the spire. Downward force originating from a hand through the spire may attach the bowl without resorting to hand pressure upon the wall of the bowl. Radial force may be more effectively utilized in affixing the bowl upon the hookah connection. The spire acts as a lever and permits a user to position and remove the bowl with slower, more deliberate motions, contrasting with a forceful downward positioning of a bowl which may often dislocate the contents of the tobacco bowl. Additionally, the bowl may be removed from the stem connection by radial force from a hand acting upon the spire.

Figure 7:
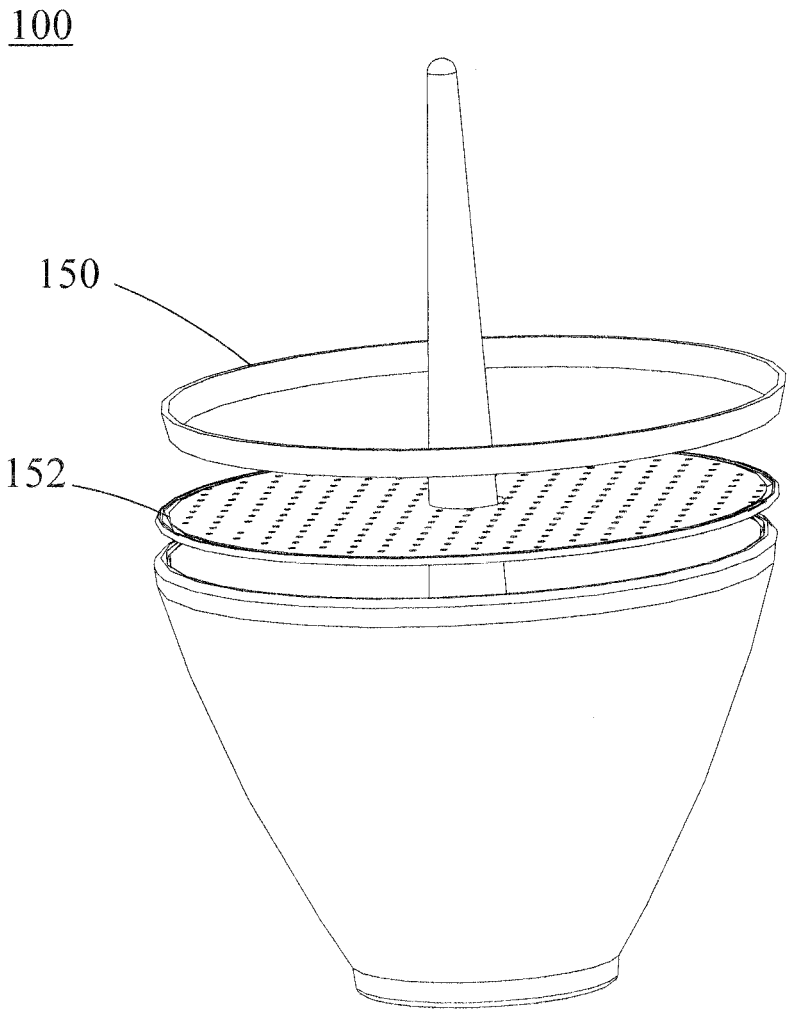
FIG. 7 is a perspective view of the system of the present invention.

As FIG. 7 shows the coal plate 120 may include a raised periphery 150 that prevents combustible material from leaving the upper surface of the coal plate 120. The raised periphery 150 may be integrally formed into the coal plate, or the coal plate 120 may include a surface indenture or track 152 about a perimeter that accepts a separable raised peripheral fence 150.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hookah bowl system comprising:

a body defining a bay bounded by a floor and a raised peripheral wall, with a peripheral wall diameter and peripheral wall height, circumscribing said floor, a base aperture, distally positioned from said bay, adapted to accept a hookah stem connection, and a dry smoke aperture positioned within said bowl body to transmit smoke from said bay to said base aperture;

an elongated, symmetric spire centrally affixed to said floor and extending beyond said raised peripheral wall height to a spire apex; and a perforated coal plate having a diameter extending at least to said raised peripheral wall and defining a central aperture dimensioned to accept said spire such that the coal plate may traverse said spire from said apex to all portions of said spire above said raised periphery.

2. The system of claim 1 wherein said spire includes a solid interior.

3. The system of claim 2 wherein said spire includes a spire girth that increases away from said spire apex towards said floor.

4. The system of claim 2 further comprising a barrier, positioned on said spire, with a barrier diameter greater than said central aperture diameter.

5. The system of claim 1 wherein said central aperture forms a minimum clearance fit with said spire at a spire section planar to said peripheral wall height.

6. The system of claim 5 wherein said coal plate is selectively removable from said spire.

7. The system of claim 6 wherein said coal plate diameter is substantially equal to said peripheral wall diameter to form a substantially flush arrangement of said coal plate and said bowl.

8. A hookah bowl system for burning wetted tobacco, said system comprising:

a body with a bay bounded by a floor and a raised peripheral wall, with a peripheral wall diameter and peripheral wall height, circumscribing said floor, a base aperture, distally located from said bay, adapted to accept a hookah stem connection, and a dry smoke aperture positioned within said bowl body to transmit smoke from said bay to said base aperture;

an elongated, symmetric spire, with a spire girth, centrally affixed to said floor, extending beyond said raised peripheral wall height to a spire apex;

a perforated coal plate, positionable upon said spire, having a diameter and defining a central aperture dimensioned to accept said spire such that said coal plate may longitudinally traverse said spire; and a spire barrier, positioned on said spire, with a barrier aperture with a barrier aperture diameter and a barrier diameter greater than said central aperture diameter, wherein said barrier diameter is greater than said spire girth of contiguous spire locations of sections of said spire received by said barrier aperture, and wherein said barrier aperture diameter is greater than said spire girth along portions of said spire effective to position said coal plate atop said barrier and provide effective combustion of a substantial amount of wetted tobacco within said body from combustible material upon said coal plate.

9. The system of claim 8 wherein said spire includes a solid interior.

10. The system of claim 9 wherein said spire includes a spire girth that increases away from said spire apex towards said floor.

11. The system of claim 8 wherein said barrier aperture forms a minimum clearance fit with said spire at a spire section planar to said peripheral wall height.

12. The system of claim 8 wherein said coal plate diameter is substantially equal to said peripheral wall diameter to form a substantially flush arrangement of said coal plate and said bowl.

13. The system of claim 8 wherein said coal plate diameter is substantially equal to said peripheral wall diameter to form a substantially flush arrangement of said coal plate and said bowl.

14. The system of claim 13 wherein said spire barrier is elastically positionable upon said spire.

15. The system of claim 14 further comprising at least two spire barriers.

* * * * *